US005743032A

United States Patent [19]

Vauhkonen

[11] Patent Number: 5,743,032

[45] Date of Patent: Apr. 28, 1998

[54] PLOUGH BLADE ARRANGEMENT

[76] Inventor: Pertti Vauhkonen, Heinälammentie 353, FIN-77120 Venetmäki, Finland

[21] Appl. No.: 495,432

[22] PCT Filed: Jan. 24, 1994

[86] PCT No.: PCT/FI94/00027

§ 371 Date: Jul. 7, 1995

§ 102(e) Date: Jul. 7, 1995

[87] PCT Pub. No.: WO94/17248

PCT Pub. Date: Aug. 4, 1994

[30] Foreign Application Priority Data

Jan. 22, 1993 [FI] Finland ..... U930032

[51] Int. Cl.[6] ..... E02F 3/36; E01H 5/04

[52] U.S. Cl. ..... 37/446; 37/232; 37/233; 172/701.3

[58] Field of Search ..... 37/446, 449, 232, 37/233, 457, 447; 172/701.1, 701.3, 772, 772.5

[56] References Cited

U.S. PATENT DOCUMENTS

| | | | |
|---|---|---|---|
| 520,479 | 5/1894 | Bunnel | 172/701.3 |
| 2,061,585 | 11/1936 | Meyer | 37/233 |
| 3,039,209 | 6/1962 | Cron et al. | 37/446 X |
| 3,466,766 | 9/1969 | Kahlbacher | 37/233 |
| 3,477,149 | 11/1969 | Wagner | 37/233 |
| 3,798,805 | 3/1974 | Hancock | 172/701.1 X |
| 3,995,384 | 12/1976 | Wood | 37/446 |
| 4,132,017 | 1/1979 | Robson et al. | 37/447 |
| 4,288,932 | 9/1981 | Küper | 37/233 |
| 4,347,677 | 9/1982 | Küper | 37/233 |
| 4,651,451 | 3/1987 | Beeley et al. | 37/233 X |
| 4,669,205 | 6/1987 | Smathers | 37/232 |
| 4,899,472 | 2/1990 | Winter | 37/264 X |
| 5,054,217 | 10/1991 | Nilsson et al. | 172/701 X |
| 5,471,770 | 12/1995 | Ferreira | 37/233 X |

FOREIGN PATENT DOCUMENTS

| | | | |
|---|---|---|---|
| 1243526 | 9/1960 | France | 172/701.3 |
| 2309674 | 11/1976 | France | 172/701.3 |
| 751891 | 7/1980 | U.S.S.R. | 37/232 |
| 874899 | 7/1980 | U.S.S.R. | 37/233 |
| 1058602 | 2/1967 | United Kingdom | 37/232 |

*Primary Examiner*—Randolph A. Reese
*Assistant Examiner*—Thomas A. Beach
*Attorney, Agent, or Firm*—Fildes & Outland, P.C.

[57] ABSTRACT

The object of the invention is a plough blade arrangement, advantageously in a snow-plough, which plough (1) is intended to be attached to a vehicle, advantageously a tractor or lorry. The plough blade arrangement includes a frame (2) consisting of a flat part removably attached to the plough (1), several blade plates (4) covering the desired working width, and attachment members for the blade plates (4) to the frame (2). The aforesaid attachment members consist of flexible members (3), which are arranged to permit the movement of the blade plates (4) essentially in only one direction in the direction of the surface of the frame (2) when the blade plate (4) strikes an obstacle or pit. In addition, the working width is divided into separate, independently flexible parts.

15 Claims, 4 Drawing Sheets

PLOUGH BLADE ARRANGEMENT

Figure 1:
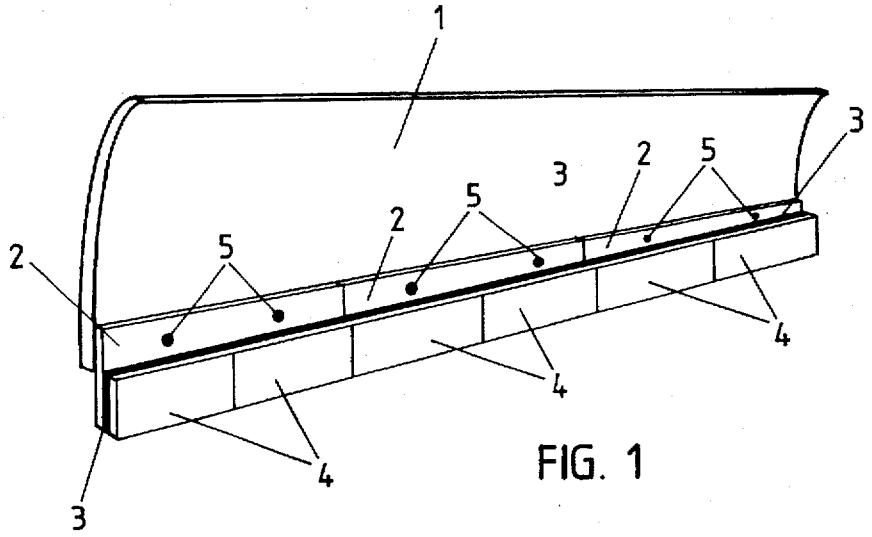

The object of this invention is a plough blade arrangement, advantageously in a snow-plough, which plough is intended to be attached to a vehicle, advantageously a tractor or lorry, the plough blade arrangement including a frame consisting of a flat part removably attached to the plough, a blade plate, and attachment devices for securing the blade plate to the frame. The plough blade arrangement in accordance with the invention is used especially in connection with the ploughing of asphalt-surfaced highways, when the intention is to clean the asphalt surface.

There is a previously known use in ploughs of various vertically and horizontally stiff blades attached to the plough, when the wear caused by friction is not directed onto the plough itself, but onto a separate, changeable blade component manufactured from, for example, steel, hard metal, or similar. These blade components are typically plate-like irons 300 mm high and 8 mm thick, the width of which varies with the width of the plough, in such a way that several blades can be attached next to the plough next to one another. During ploughing, the angle between the blade and the road is generally about 55°–70°, when the lower edge of the blade is further forward than the upper in the direction of travel. The blade then presses against the road with a force corresponding to about 1000 kg. The greatest problem with known blades used in ploughing is their rapid wear, which is considerably promoted by unevennesses in the road. 0n the basis of experience is has been demonstrated that even a plough blade of hard metal will wear very rapidly, especially if there are many unevennesses in the road being ploughed. In addition to this, the road surface too wears. The wear is due above all to the fact that when the stiff plough blade hits an unevenness in the road, and the plough blade is pressed down with a force corresponding to 1000 kg, then either the plough blade or the road surface will be damaged before the plough has been raised sufficiently to clear the unevenness. In addition, the surface left by stiff blades is unsatisfactory, especially on a rutted road, on account of which use is also made of ploughs, in which there is, for example, a plough in front equipped with a large, stiff, steel blade, and behind it a small plough equipped with a small rubber blade for final cleaning.

The intention of this invention is to create a plough blade arrangement, by means of which the ploughed surface is better, and in which unevennesses in the road cause considerably less wear compared to known blades, and which correspondingly wears the road being ploughed less than known plough blades. These goals are achieved by means of a plough blade arrangement in accordance with the invention, the characteristic features of which are presented in the accompanying Patent claims.

The invention is based on the idea that the blade component in contact with the road is flexibly attached to the plough, in which case the blade component flexes upwards when it strikes an unevenness in the road. The most significant advantage of the invention is thus that the blade component of the plough, and the road being ploughed wear significantly less than when using known plough blade arrangements. In addition, when using a plough blade arrangement in accordance with the invention, there is the advantage that when the plough strikes an unevenness in the road extending over only part of the width of the plough the blade component does not rise over its entire width, but only at the point of the unevenness and/or from the angle on the side of the unevenness, when the blade component of the plough and the road surface are momentarily at a certain angle to one another. A significantly better cleaning result is achieved, especially on rutted roads, by means of a plough blade arrangement in accordance with the invention, in which separate components are used that yield to the surface of the road.

Figure 2:
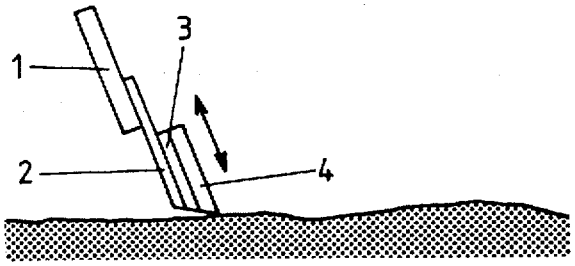
Figure 3:
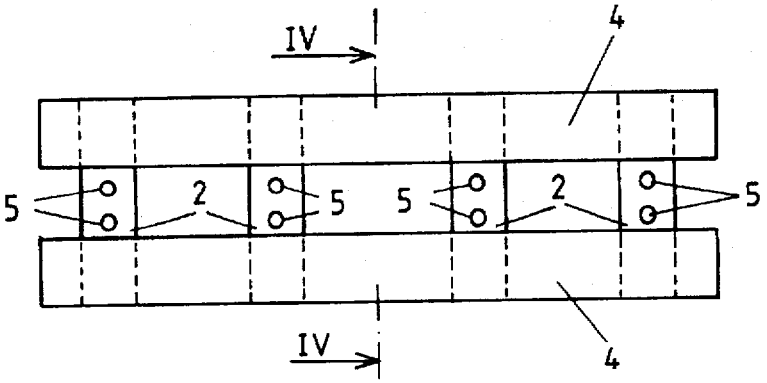
Figure 4:
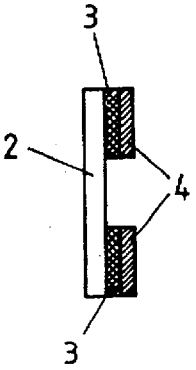
Figures 6, 7:
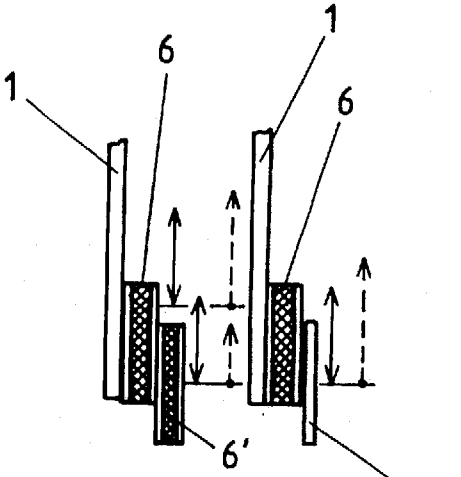
Figure 5:
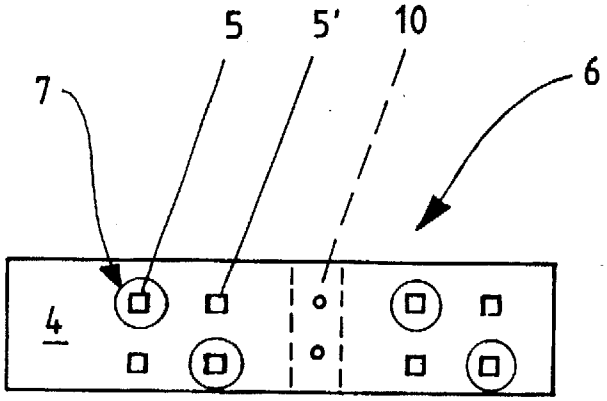
Figure 8:
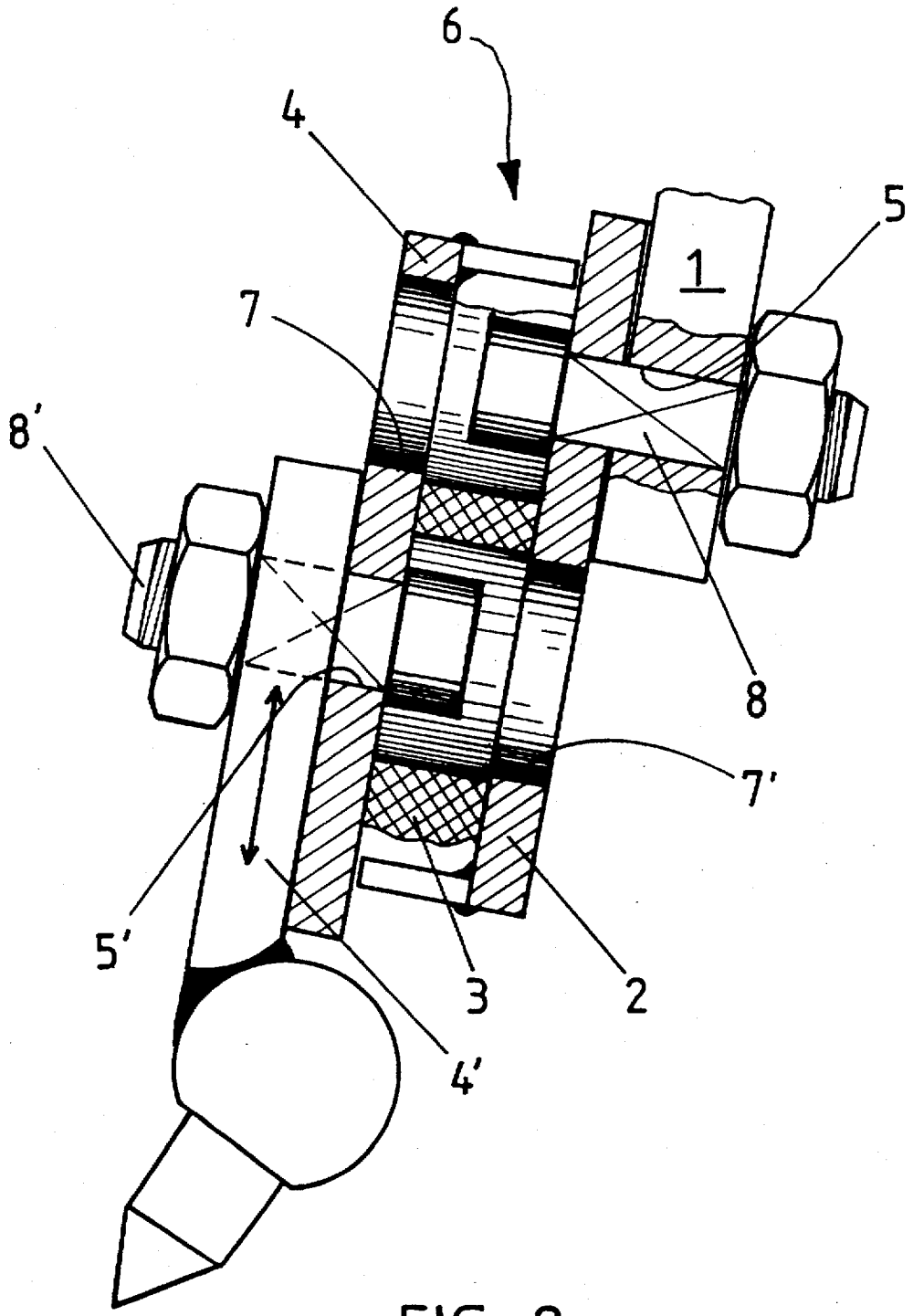
Figure 9:
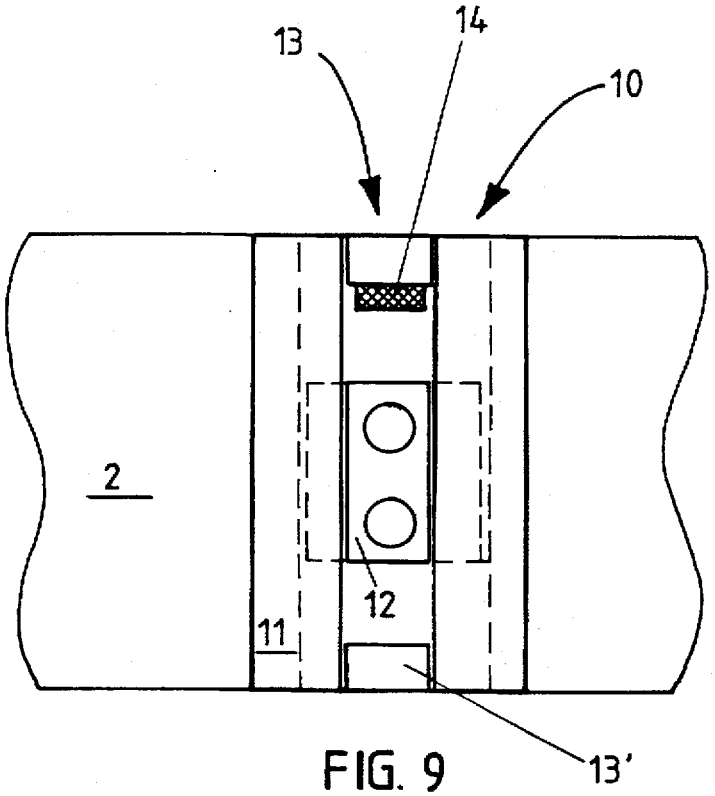
Figure 10:
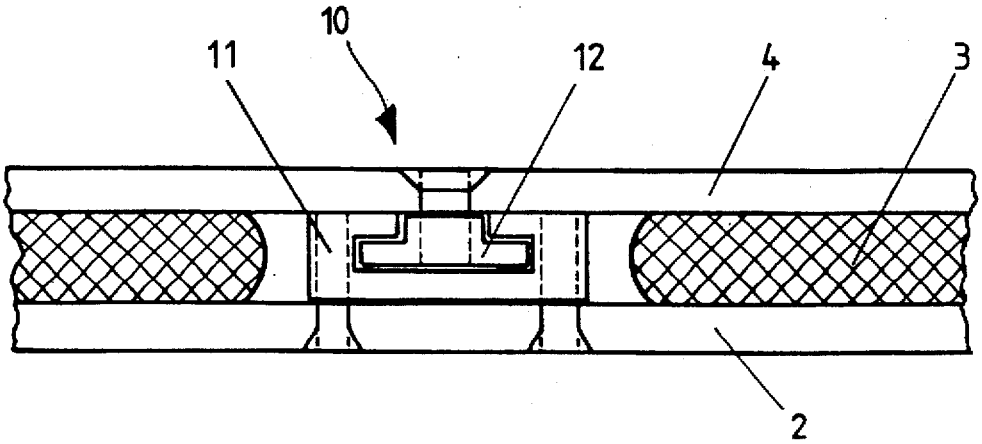

A plough blade in accordance with the invention is described in what follows with the aid of two advantageous forms of application, with reference to the accompanying drawings in which FIG. 1 shows the first form of application of the plough blade seen from in front, FIG. 2 shows the plough blade of FIG. 1 seen from the side, FIG. 3 shows the second form of application of the plough blade seen from in front, FIG. 4 shows a cross-sectional view of the plough blade in FIG. 3 along the line IV—IV in FIG. 3, FIG. 5 shows one independently flexible flexing member, FIG. 6 shows a plough blade arrangement using the flexing member in FIG. 5, FIG. 7 shows another blade arrangement using the flexing member in FIG. 5, FIG. 8 shows a third blade arrangement using the flexing member in FIG. 5, FIG. 9 and 10 shows the slide member of FIG. 5 in detail.

FIG. 1 shows one plough blade in accordance with the invention as seen from in front. The plough blade includes three frames 2, which are attached to the plough by means of bolts penetrating holes 5 of the flat frames 2. There are two separate blade plates 4 attached to lower part of each frame 2 by means of a component 3 manufactured from a flexible elastomer material, advantageously for example rubber, polyurethane, or a corresponding flexible material. The blade plates 4 are manufactured from some material that has a high wear resistance, such as e.g. steel or hard metal. There may by gaps between the blade plates 4, in which case grooves will form in the track of the plough. Each blade plate 4 can flex vertically independently of the others if the plate in question strikes an unevenness in the road surface. The frames 2 shown in FIG. 1 can naturally be replaced by a single unified frame component.

FIG. 2 shows the blade attached to the plough 1 in FIG. 1, seen from the side. The plough shown in the Figure moves to the right during ploughing. The plough frame 2 is attached by bolts to plough 1 (not seen in the Figure). Plate 3, manufactured from flexible material, is adherently attached to frame 2 such as by vulcanizing or bonding. Blade plate 4, which is manufactured from some material that has a high wear resistance, is adherently attached in similar fashion to the flexible plate. Blade plate 4 is thus flexibly resiliently attached to frame 2. From the point of view of the invention it is essential that the blade of the plough cannot bend or rotate backwards in relation to the direction of ploughing, even though the blade plate of the plough strikes the road surface. If this should happen the blade of the plough would catch on the road surface with even greater force than previously. The reason for the above catching would be that as a result of bending or rotating backwards the blade of the plough would move vertically increasingly further downwards from its normal position, because the angle between the plough blade and the road is about 55°–70°. The above-mentioned problem does not appear in connection with the use of the blade in accordance with the invention shown in FIG. 2, because the stiff frame 2 extends vertically nearly as far down as the blade plate 4, so that it supports the blade plate in the direction of ploughing. The flexing of the blade plate 4 also takes place mainly vertically, and more precisely in the direction of the surface of frame 2, which is shown by the arrow in FIG. 2.

FIGS. 3 and 4 show another rotatable plough blade arrangement in accordance with the invention. In these Figures the same reference numbers as above are used for operationally similar components. In FIG. 3 the plough blade is seen from in front, and in FIG. 4 it is seen in cross-section along line IV—IV in FIG. 3. The three frames shown in FIG. 1 have been replaced in FIG. 3 by four separate frames 2, which are attached to solid blade plates 4 by means a component manufactured from a flexible material. The blade plates 4 are thus flexibly attached to each separate frame 2. When the blade plate 4 fitted to the lower part of the frames 2 has been completely worn, the frames 2 are separated from the plough and re-attached to it the other way round in such a way that the blade plate 4 that was previously upper becomes lower.

In FIGS. 5–10 too the same reference numbers as above are used for operationally similar components. In the forms of application of FIG. 1–4 the blade plate itself acts as the wearing blade, but in the forms of application presented later blade plate 4 is attached by means of a snap-fit to a separate wear component. The flexible member in accordance with FIG. 5 makes the snap-fit possible in such a way that it is attached to the base plate of the plough 1 by holes 5 visible in the installation opening 7, and a wearing blade component, of which FIGS. 6–8 show various alternative versions, is attached to this by corresponding snap-fit bolts. The wearing blade in FIG. 6 is formed of a second flexible member 6' similar to flexible member 6, in which case a greater overall flexibility is achieved. A conventional blade plate 4' to be attached to flexible member 6 is shown in FIG. 7. Because separate flexible members 6 make it possible for separate blades 4' to conform to the road surface, these wear considerably less than previously. FIG. 8 shows a spiked blade 4' to be attached to the flexible member 6. The Figure also shows a cross-section of flexible member 6 at the point of the installation openings. Flexible member 6 consists of blade plate 4 and frame 2 in accordance with the above, as well as the flexible material 3 that secures these. Frame 2 is attached to the base plate of plough 1 by means of snap-fit bolts 8. For this purpose there are holes 5 in frame 2, which are located in the centre of the installation opening 7. This installation opening 7 extends through the blade plate 4 and the flexible material, freeing the space required for the installation of bolt 8. Opening 5 is square, as is the shank of the bolt, thus making it easy for the securing nut to be screwed tight. On the opposite side there is a similar installation opening 7', which extends through the frame 2 and the flexible material to the blade plate 4, in which there is a corresponding square hole 5'. The wear blade component here spiked blade 4', is attached to blade plate 4 by means of bolts 8'. According to the Figure the thickness of the flexible material 3 is small compared to its height, so that the rotation of blade plate 4 in relation to frame 2 is avoided. This kind of construction forces the blade plate 4 to move essentially upwards in the direction of frame 2. The thickness of the flexible material may be at most ¼, but most advantageously 1/10–1/5 of its height. Considering an overall working width of about four meters the width of the separate flexible components may be at most 1 m, but more advantageously 40–80 cm. By means of a 20 cm high flexible component a total flex of 15 mm is obtained, when the thickness of the flexible vulcanized rubber is about 20 mm.

The loading of the flexible material can be reduced, especially under great loadings by the use of a slide member, which can be attached to the stop that limits movement. The slide member in accordance with FIGS. 9 and 10 is located in the flexible member 6. In FIG. 9 the blade plate 4 and the flexible material have been considered as having been removed, so that the slide device 10 can be seen in its entirety. The slide device 10 includes a rail 11 attached to frame 2 and a slide 12 adapted to this, which is attached to blade plate 4. Stops 13 and 13' are also attached to frame 2. Flexible component 14, which damps the stop, is attached to the former of these. Stops 13 and 13' limit slide 12 and thus the movement of blade plate 4 and prevent the overloading of flexible material 3.

The accompanying Figures and the related description are intended only to illustrate the invention being referred to. In details the plough blade in accordance with the invention can vary within the frame work of the Patent claims. Thus a plough blade arrangement in accordance with the invention can also be used, for example, in large-area ploughs, bulldozer blades, foundation and road graders, and corresponding purposes, even though the plough blade arrangement in accordance with the invention has been described above mainly for snow-ploughing on highways. It should be noted in addition, that even though the description above states that there is only a single component manufactured from flexible material, this component can naturally be replaced by several separate flexible components. It is also possible to alter the number of separate blade and frame components as required, in order that the resulting effect is as desired, for example, grooved in the case of ploughing/grading packed snow and ice.

I claim:

1. A plough blade arrangement intended to be attached to a vehicle, the plough blade arrangement including a frame including a flat part removably and rigidly attached to a plough, several blade plates covering a desired working width and divided into separate and independent parts, and flexible attachment members for securing the blade plates to the frame and comprising flexible elastomeric material bonded between the frame and the blade plates, characterized in that each flexible member comprises an elastomeric plate having essentially an even thickness and directly opposite parallel surfaces, with one of said surfaces adherently fixed on a surface of the frame and the opposite of said surfaces adherently fixed on a frame-opposing parallel surface of the blade plate and each flexible member has a thickness at most ¼ of its height to permit the movement of the blade plates essentially in a direction parallel with said surface of the frame when the blade plate strikes an obstacle or pit wherein the arrangement includes a stop, which limits the movement of the blade plate.

2. A plough blade arrangement in accordance with claim 1, characterized in that the stop is made flexible in such a way that when the blade plate approaches the extreme position, its movement demands increasing force.

3. A plough blade arrangement in accordance with claim 2 characterized by slide members, which force the blade plate to move only along a desired track.

4. A plough blade arrangement in accordance with claim 1, characterized in that the arrangement includes several separate flexible elements, each one of which includes a frame, a flexible member, and a blade plate.

5. A plough blade arrangement in accordance with claim 4 characterized by slide members, which force the blade plate to move only along a desired track.

6. A plough blade arrangement in accordance with claim 1, characterized by slide members, which force the blade plate to move only along a desired track.

7. A plough blade arrangement in accordance with claim 1 characterized in that the arrangement includes several separate flexible elements, each one of which includes a frame, a flexible member, and a blade plate.

8. A plough blade arrangement in accordance with claim 7 characterized by slide members, which force the blade plate to move only along a desired track.

9. A plough blade arrangement in accordance with claim 1 characterized by slide members, which force the blade plate to move only along a desired track.

10. A plough blade arrangement in accordance with claim 1 characterized in that each flexible member has a thickness in the range of 1/10 to 1/5 of its height.

11. A plough blade arrangement in accordance with claim 1 characterized in that the working width of the independently flexible blades is not more than 1 m.

12. A plough blade arrangement in accordance with claim 11 wherein said thickness of each flexible member is in the range of 1/10 to 1/5 of its height.

13. A plough blade arrangement in accordance with claim 1 characterized in that the working width of the independently flexible blade plates is in the range of 40–80 cm.

14. A plough blade arrangement in accordance with claim 12 characterized in that each flexible member has a thickness in the range of 1/10 to 1/5 of its height.

15. A plough blade arrangement in accordance with claim 1 characterized in that at least one of the frame and the blade plate includes attachment holes for receiving fasteners, and installation openings aligned with said installation openings in the flexible member and the opposite one of the frame and blade plate.

* * * * *